US006742843B2

(12) United States Patent
Golynsky

(10) Patent No.: US 6,742,843 B2
(45) Date of Patent: Jun. 1, 2004

(54) CABLE CONTROL WITH OVERLOAD PROTECTION DEVICE

(75) Inventor: Arkady Golynsky, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 10/280,440

(22) Filed: Oct. 25, 2002

(65) Prior Publication Data

US 2004/0080200 A1 Apr. 29, 2004

(51) Int. Cl.[7] ..... A47C 3/026
(52) U.S. Cl. ..... 297/363; 297/364; 297/365
(58) Field of Search ..... 297/300.8, 300.3, 297/361.1, 363, 364, 365, 378.14; 74/501.5 R, 502, 502.4

(56) References Cited

U.S. PATENT DOCUMENTS 1,173,620 A * 2/1916 Thompson ..... 251/149.1
2,340,830 A * 2/1944 Arens ..... 74/502.3
5,080,434 A 1/1992 Locher
5,211,071 A * 5/1993 Hedstrom ..... 74/501.5 R
5,499,861 A * 3/1996 Locher ..... 297/301.2
5,658,047 A * 8/1997 Ratza et al. ..... 297/378.14
5,752,414 A * 5/1998 Reasoner et al. ..... 74/483 R
5,839,866 A * 11/1998 Moen et al. ..... 411/5
6,164,724 A * 12/2000 Greaves ..... 297/378.14
6,213,552 B1 * 4/2001 Miotto ..... 297/300.5
6,439,078 B1 * 8/2002 Schlude et al. ..... 74/527
6,513,876 B1 * 2/2003 Agler et al. ..... 297/378.14

FOREIGN PATENT DOCUMENTS

JP 57022929 A * 2/1982 ..... B06N/1/08

* cited by examiner

*Primary Examiner*—Peter M. Cuomo
*Assistant Examiner*—Stephen D'Adamo
(74) *Attorney, Agent, or Firm*—Buchanan Ingersoll, P.C.

(57) ABSTRACT

The present invention discloses an overload protection mechanism for a cable actuated feature on an office chair. The overload protection device allows a person seated in the chair to move a handle to actuate the particular feature of the chair, for example, a reclining backrest, even when the seated person's weight on the backrest prevents the backrest locking mechanism from engaging or disengaging. The movement of the handle causes the cable to move even when the locking mechanism connected to the opposite end of the cable is unable to engage or disengage. The mechanism stores the motion of the cable in a spring device connected to the movement actuators by a rack and pinion gear system. When the binding is released from the actuators, the mechanism moves as originally intended, motivated by the force of the decompressing springs.

11 Claims, 7 Drawing Sheets

CABLE CONTROL WITH OVERLOAD PROTECTION DEVICE

FIELD OF THE INVENTION

The present invention relates to the field of adjustable chairs and, in particular, to an office chair having an adjustable backrest.

BACKGROUND OF THE INVENTION

The typical office chair consists of a seat portion and a backrest portion and, optionally, armrest portions, all supported by a pedestal, usually having wheels thereon for movement of the chair about the work area. It is well known in the prior art for the backrest portion of the chair to be adjustable from an upright position to a position that is semi-reclined, usually as the result of pushing back of the backrest by a person seated in the chair. The seat portion of the chair may or may not move in accordance with the backrest portion when it is reclined. Typically, the backrest portion is coupled with a spring such that when pressure is released on the reclining backrest portion, the backrest portion returns to an upright position.

In many instances, it may be desirable to limit the motion of the backrest portion of the chair. The limiting of the motion of the backrest can be in one of two forms. First, the distance that the backrest can be reclined can be limited and, second, when the backrest is reclined, the backrest can be prevented from returning to the upright position when pressure is released, thereby leaving the chair in a reclined position.

One simple way to accomplish the locking of the backrest in various configurations is to have one or more locking members which can be inserted into recesses in the chair frame at the appropriate places to limit the movement of the backrest. However, one problem with this mechanism is that movement of the locking members into and out of the recesses tends to bind when pressure is being applied to the backrest, either by the backwards pushing of a person sitting in the chair or by the movement of the backrest to the upright position as a result of springs in the chair. As a result of the binding, the locking members will be unable to move into and out of the recesses.

In the type of movement limiting device described, the locking member is typically adjusted by the user through the use of a lever attached to the side of the chair, which is easily accessible to a person sitting in the chair. The lever may be attached to a cable which is in turn attached to the mechanism for moving the locking members into and out of the recesses in the frame of the chair. One problem with this mechanism is that it may be desirable to have one stop on each side of the chair frame, to ensure even operation. Therefore, a mechanism is needed to translate the motion of a single cable into a back and forth motion capable of moving one or more locking members. The second problem with such a mechanism is that when the locking members are bound by pressure applied by the backrest of the chair, the locking members will not move when the person seated in the chair actuates the cable. If the user exerts enough pressure on the bound mechanism, it can result in the breaking of any one of a number of parts in the linkage from the lever to the locking members. Therefore, it would be desirable to have a device which, first, translates the movement of a lever-actuated cable into a back and forth motion that can slide the locking members into and out of the recesses and, second, allows movement of the cable in response to the user actuating the lever connected to the cable without damaging the translation mechanism.

SUMMARY OF THE INVENTION

The present invention provides a mechanism using a rack and pinion gear configuration that is capable of translating the motion of a cable to the back and forth motion of one or more locking members with respect to one or more corresponding recesses in the chair frame. The mechanism also incorporates an overload protection device whereby movement of the cable, when the locking members are bound in the recesses, results in compression of springs which store the energy necessary to move the locking members with respect to the recesses once the binding is removed.

The mechanism is constructed generally of a housing and a member able to slide radially within the housing. A spring is disposed between the slide member and the housing which is compressed when the slide member slides within the housing, but when the housing is unable to move due to a binding condition. The slide member is attached to a cable which, when tensioned, causes motion of the slide member within the housing such as to compress the spring, thereby urging the housing in a first direction. An additional spring is disposed between the end of the cable and the housing to urge the housing in the opposite direction when the tension on the cable is released. Attached to the housing with a rack and pinion assembly are two actuators which, when rotated by the rack and pinion assembly, cause one or more locking members to be inserted into or withdrawn from recesses defined in the chair frame. The presence of the locking members in the recesses results in the locking of some aspect of the chair, such as the backrest.

DETAILED DESCRIPTION OF THE INVENTION

Figure 1:
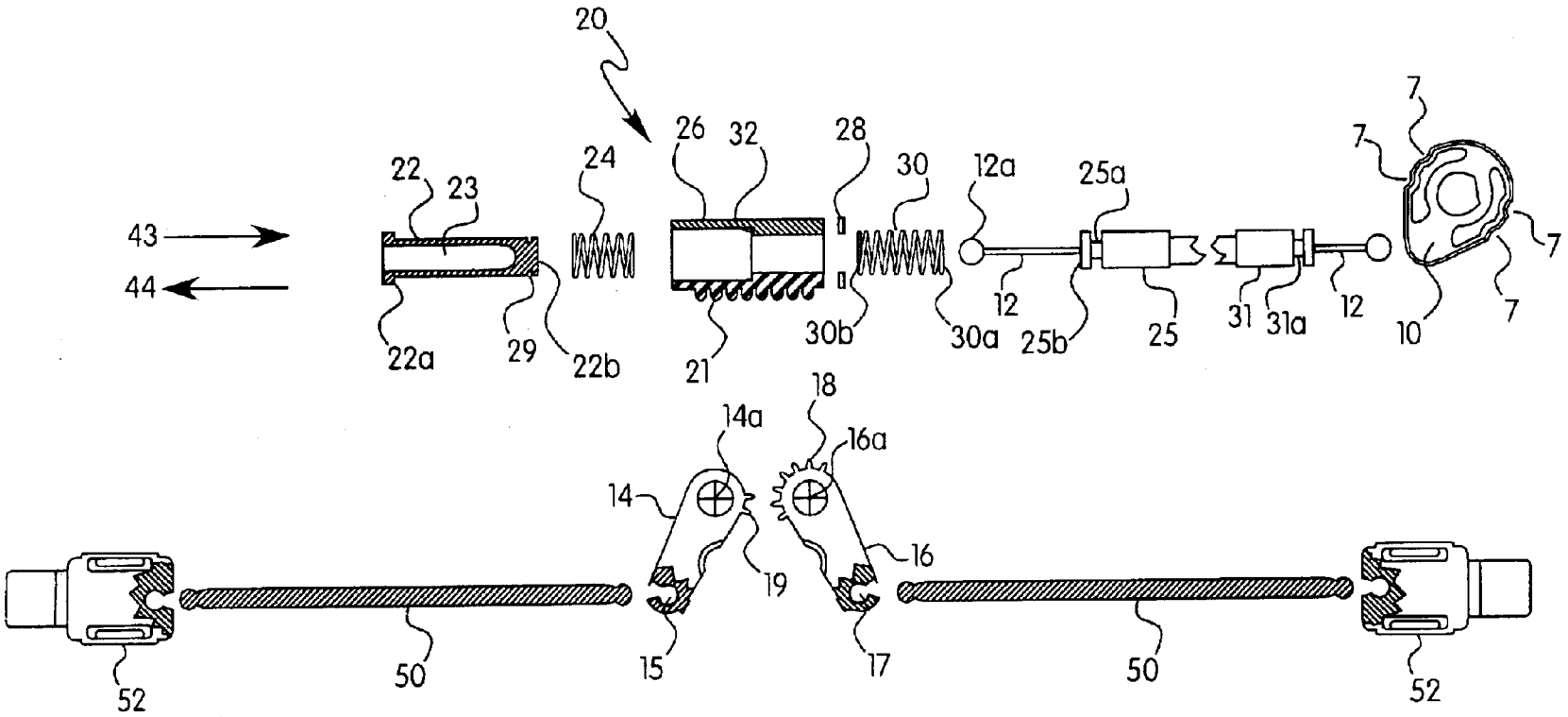
FIG. 1 is an exploded view of the preferred embodiment of the invention.

With reference to FIG. 1, the construction of overload protection device 20 is clearly shown in a cross-sectional, exploded view. Slide member 22 includes cavity 23 which receives ball or barrel 12*a* disposed on the end of cable 12.

The housing of cable 12 is fitted on the end thereof with cable end coupling 25, on which is defined slot 25*a*. Slot 25*a* serves to attach cable end coupling to chair frame 8 at any convenient spot (see FIGS. 6 and 7). Likewise, the opposite end of cable 12, which is connected to cable actuator 10, also is fitted near the end thereof with cable end piece 31, which defines slot 31*a*. Slot 31*a* serves to attach this end of cable to any convenient spot on chair frame 8.

Cable actuator 10 may be of any given shape, but, in the preferred embodiment, is in the shape of a cam having detents 7 defined therein. Detents 7 may engage protrusions defined in chair frame 8 (not shown) to define two or more positions as actuator 10 is rotated.

Spring 24 is situated around the outside circumference of slide member 22, and slide member 22 and spring 24 are inserted within spring housing 26. Spring housing 26 has shoulder 32 defined therein, which allows the travel of slide member 22 to be limited within spring housing 26. Spring 24 rests against shoulder 32 of spring housing 26 and shoulder 22*a* defined on slide member 22. Slide member 22 is held within spring housing 26 by E-ring 28, which is disposed in slot 29 defined in slider 22. Spring 30 at end 30*a* is situated around end portion 25*b* of cable end coupling 25 and is radially aligned with slide member 22, spring housing 26, cable 12 and spring 24. The opposite end 30*b* of spring 30 is disposed around end portion 22*b* of slide member 22.

Actuators 14 and 16 are coupled to spring housing 26 via a rack and pinion gear assembly comprised of teeth 21 defined on spring housing 26 and teeth 18 and 19, defined on actuators 16 and 14 respectively. When spring housing moves in direction 43, the interaction between teeth 21 on spring housing 26 and teeth 18 on actuator 16 causes actuator 16 to rotate in a clockwise direction about point 16*a*. The interaction between teeth 18 on actuator 16 and teeth 19 on actuator 14 causes actuator 14 to rotate in a counterclockwise direction about point 14*a*. Likewise, movement of spring housing 26 in direction 44 will cause actuators 14 and 16 to rotate in clockwise and counterclockwise directions respectively.

The rotational movement of actuators 14 and 16 causes a back-and-forth movement of locking members 52 via coupling rods 50, which may be connected between actuators 14 and 16 and respective locking members 52 via ball and socket assemblies 15 and 17. Thus, the linear motion of a single cable 12 is translated into a back-and-forth motion for multiple locking members 52, fulfilling one object of the invention.

Figure 6:
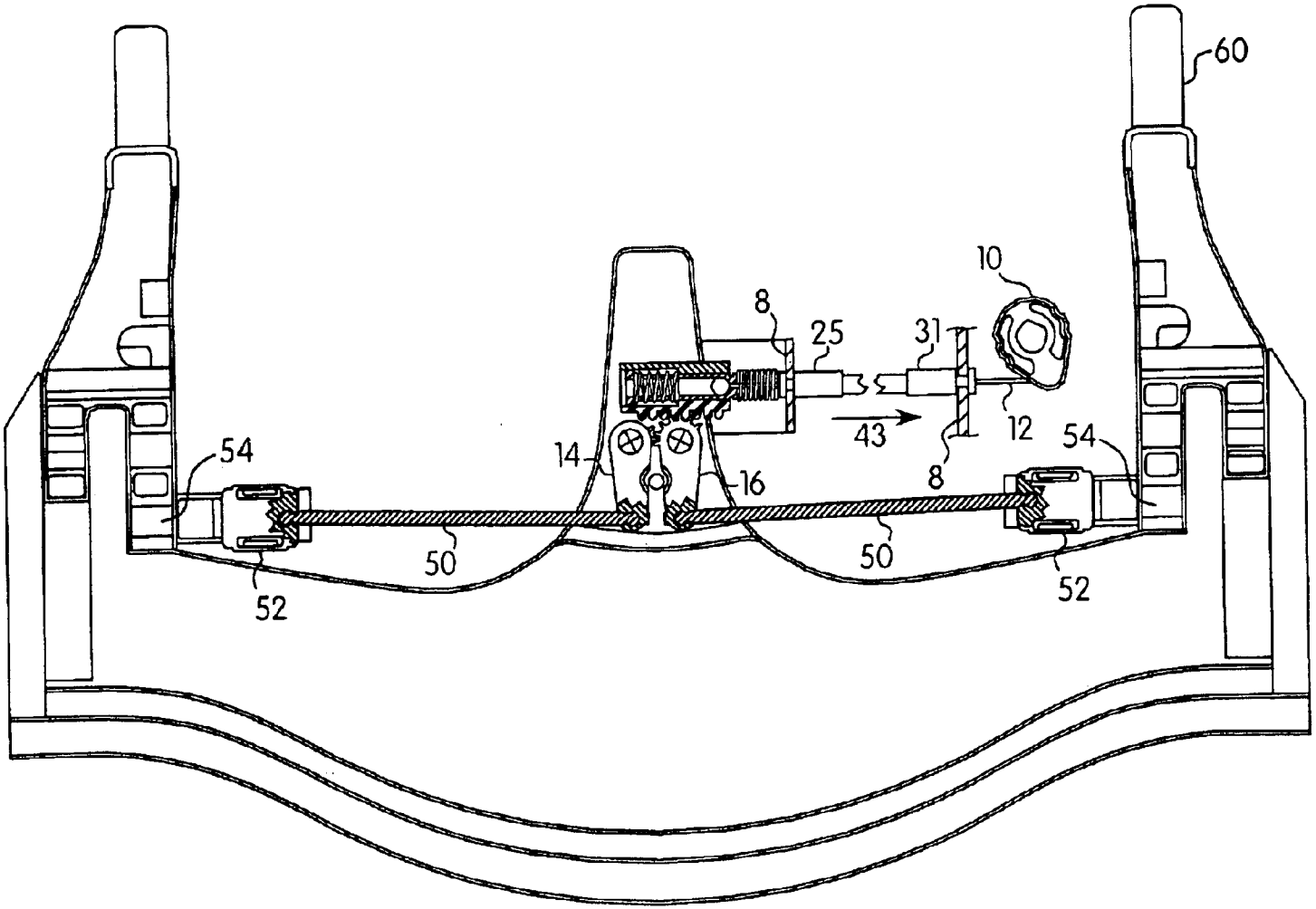
FIG. 6 is a top plan view of the device of the invention in situ in a chair frame, where the locking mechanism is in an unlocked position.
Figure 7:
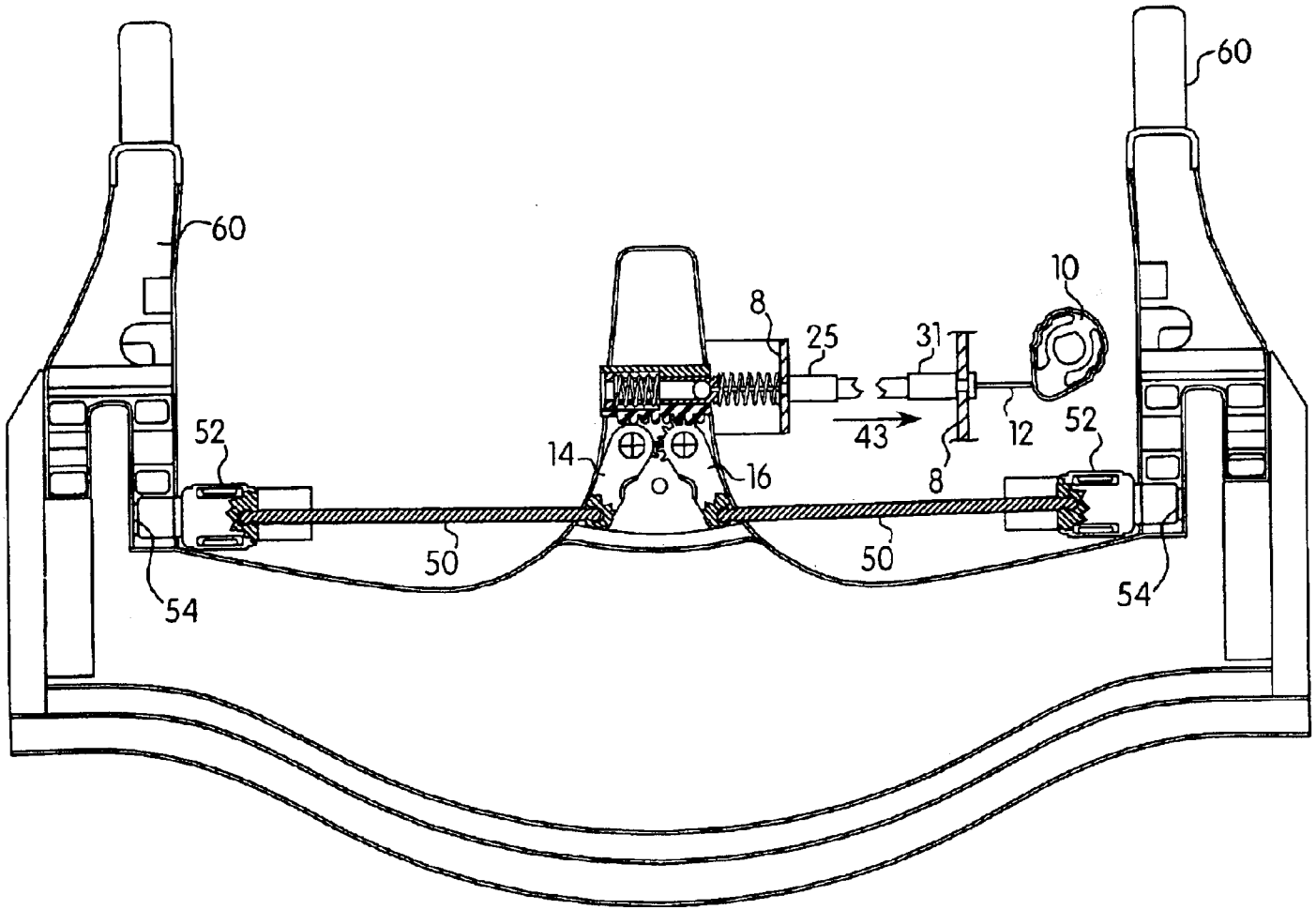
FIG. 7 is a top plan view of the device of the invention in situ in a chair frame, where the locking mechanism is in a locked position.

The device of the present invention is normally installed under the seat of an office type chair and is shown in situ in FIGS. 6 and 7. Chair frame 8 is a supporting structure of the chair which would typically be connected to a support post underneath and which would have the seat of the chair mounted thereon, covering the locking mechanism of the present invention from normal view.

The locking mechanism will typically lock and unlock some aspect of the movement of the chair, such as the reclining of the backrest 60. Cable actuator 10 is preferably located at some convenient position on chair frame 8 in proximity to the hand of a person seated in the chair, such that cable actuator 10 can be comfortably manipulated. Typically, a lever type member (not shown) would be connected to cable actuator 10 to facilitate the manual rotational movement thereof by the user.

Figure 2:
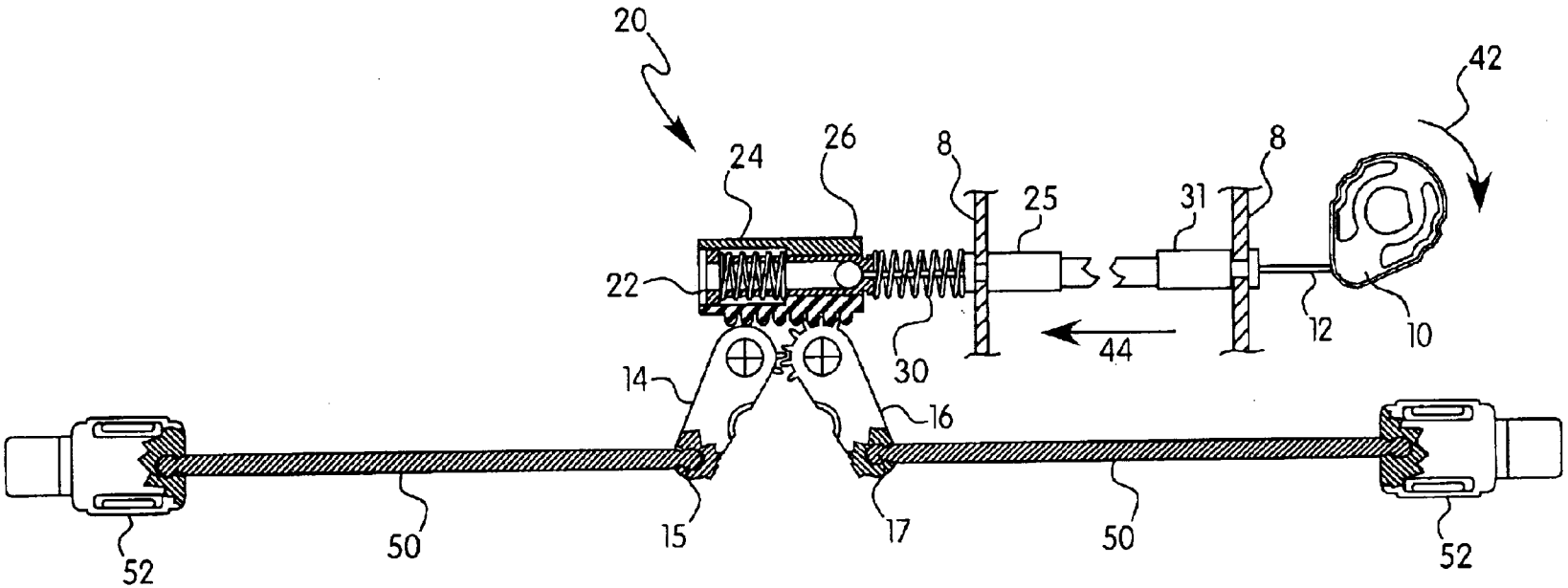
FIG. 2 is a top plan view of the device of the invention wherein the locking mechanism is in a locked position and wherein movement of the cable and locking mechanism is unrestricted.

When in a locked position, locking members 52 are inserted into recesses 54, best shown in FIGS. 6 (unlocked) and 7 (locked) via coupling rods 50 by movement of cable actuator 10 in direction 42 as shown in FIG. 2. When unlocked, locking members 52 are withdrawn from recesses 54 by coupling rods 50 by movement of cable actuator 10 in direction 41 as shown in FIG. 3.

Figure 3:
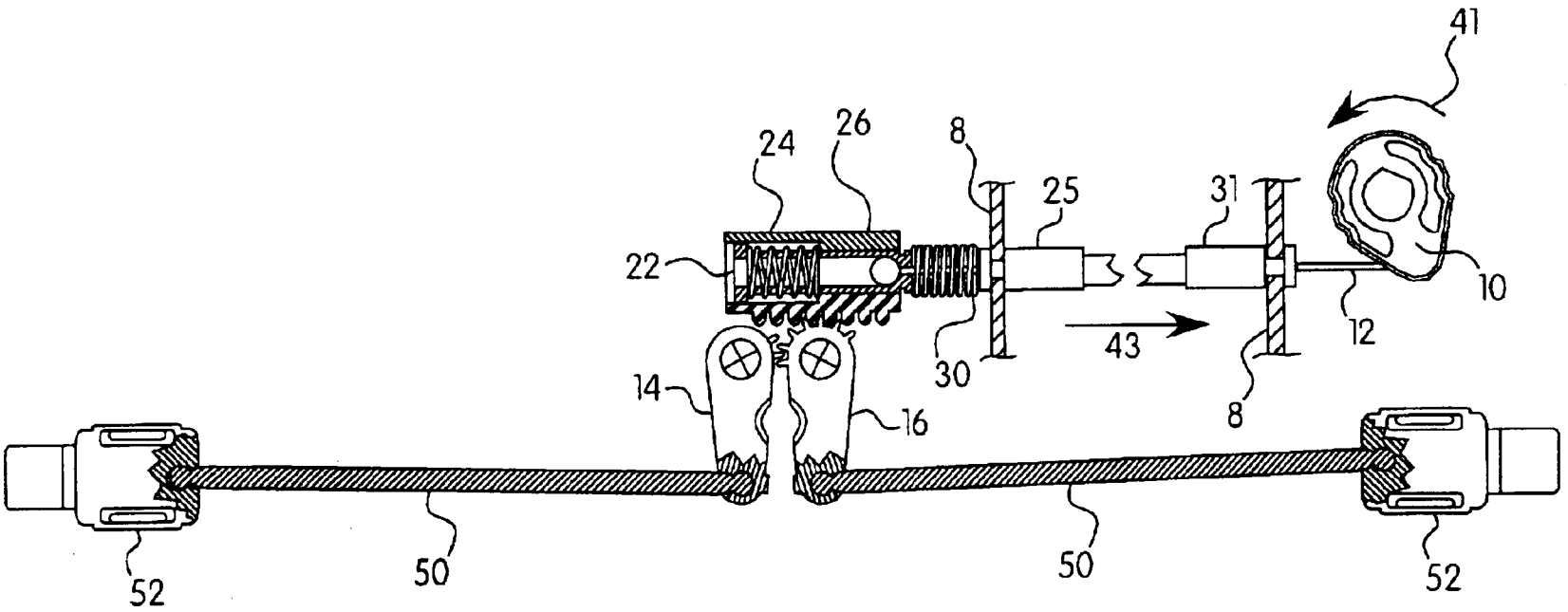
FIG. 3 is a top plan view of the device of the invention wherein the locking mechanism is in an unlocked position and wherein movement of the cable and locking mechanism is unrestricted.

FIGS. 2 and 3 show the locking mechanism in locked and unlocked positions respectively in a situation where no binding of locking members 52 within recesses 54 is occurring. In FIGS. 2 and 3, locking members 52 are unbound and free to move into and out of recesses 54, therefore overload protection device 20 merely serves to transfer the motion of cable 12 to locking members 52.

In normal operation the mechanism is moved from an unlocked position, as shown in FIG. 3, to a locked position, as shown in FIG. 2, when actuator 10 is rotated in direction 42. FIGS. 2 and 3 show the mechanism absent a binding condition. In this situation, when actuator 10 is rotated in direction 42, cable 12 moves in the direction of arrow 44 and allows the motion of spring housing 26 in direction 44 as the result of the decompression of spring 30. Spring housing 26 has rack gears 21 defined thereon, which move pinion gears 19 and 18 on actuators 14 and 16 respectively. The rotation of actuators 14 and 16 causes connecting rods 50, which may be connected to actuators 14 and 16 by ball and socket joints 15 and 17, to move outwardly, thereby causing locking members 52, connected to the opposite ends of connecting rods 50, to be inserted into recesses 54 (see FIG. 7). This presence of locking member 52 within recesses 54 serves to lock backrest 60 of the chair, preventing it from moving.

The corresponding normal movement from a locked position in FIG. 2 to an unlocked position in FIG. 3 occurs when no binding condition exists and actuator 10 is rotated in direction 41. Cable 12 moves in the direction of arrow 43, causing slide member 22 to also move in direction 43 within spring housing 26. The movement of slide member 22 causes spring 24 to contact shoulder 32 in spring housing 26. Because spring housing 26 is free to move due to the absence of a binding condition, spring housing 26 also moves in direction 43. Also, spring 30 compresses due to the pressure from E-ring 28 moving with slide member 22. The resulting rotation of actuators 14 and 16 causes connecting rods 50, to move inwardly, thereby causing locking members 52 to be withdrawn from recesses 54 (see FIG. 6). This unlocks backrest 60 of the chair, allowing it to move freely.

Figure 4:
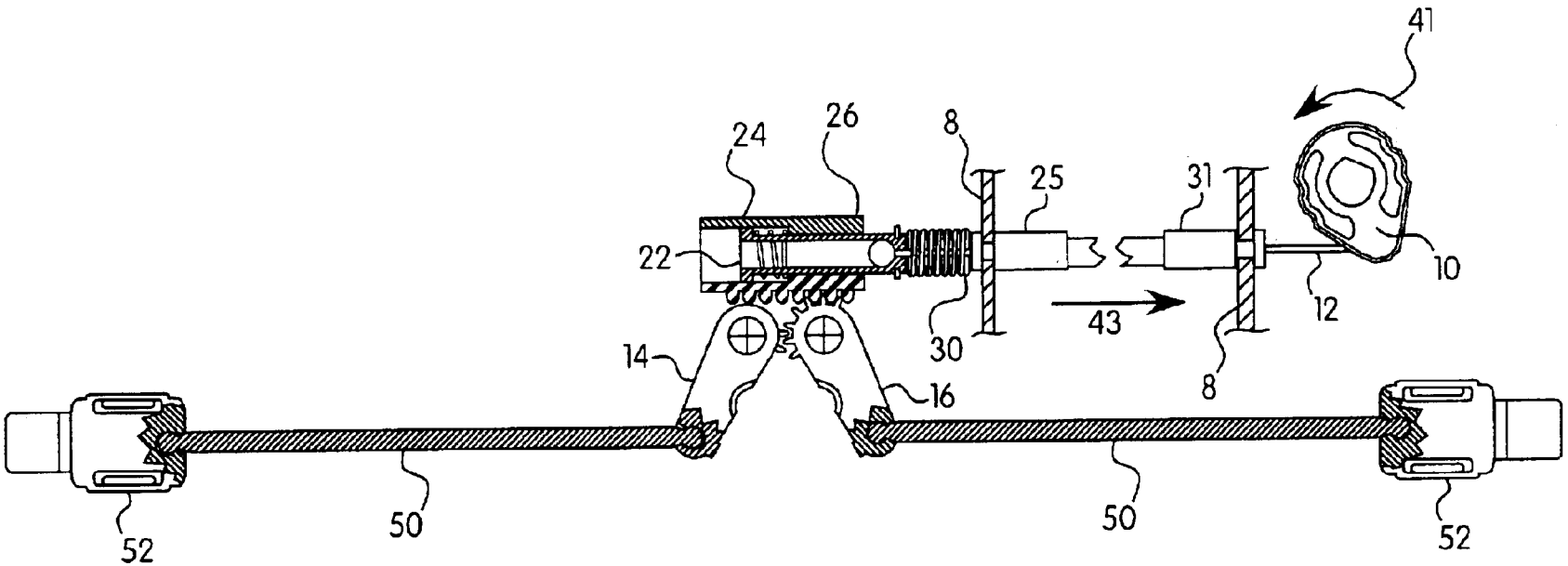
FIG. 4 is a top plan view of the device of the invention wherein the locking mechanism is in a locked position and wherein movement of the cable and locking mechanism is restricted.

FIG. 4 shows the locking mechanism wherein cable actuator 10 has been rotated in direction 41 to the unlocked position, but wherein locking members 52 are unable to be withdrawn from recesses 54 because they are bound therein by pressure applied by the backrest of the chair. In this case, slide member 22 is moved in direction 43 within spring housing 26, thereby compressing spring 24 between shoulder 32 defined within spring housing 26 and shoulder 22*a* defined on slide member 22. Spring 30 is also compressed. When the binding condition has been removed, for example, by the release of pressure on the backrest of the chair, locking members 52 are able to move freely out of recesses 54, spring 24 decompresses, urging spring member 26 to move in direction 43, causing locking members 52 to be withdrawn from recesses 54.

Figure 5:
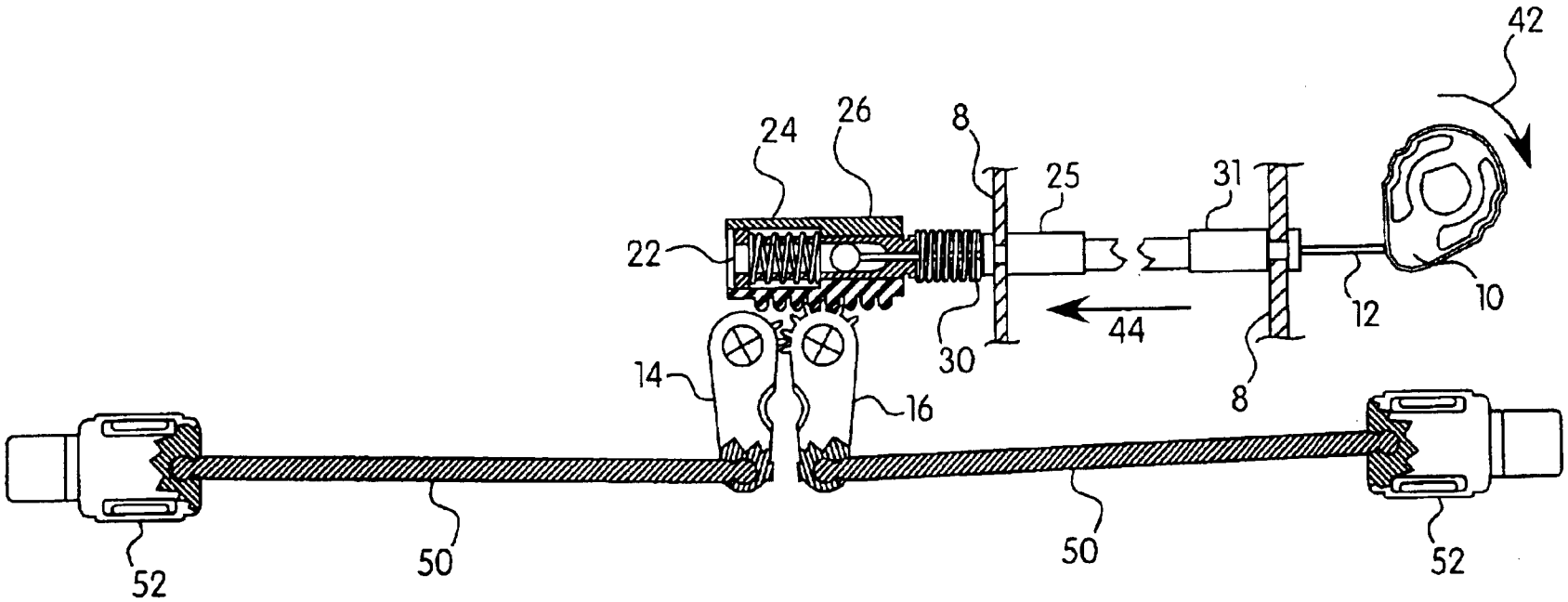
FIG. 5 is a top plan view of the device of the invention wherein the locking mechanism is in an unlocked position and wherein movement of the cable and locking mechanism is restricted.

The corresponding locking motion is shown in FIG. 5. In this case, cable actuator 10 has been moved into the lock position causing cable 12 to move in direction 44. Note that ball or barrel 12*a*, disposed on the end of cable 12, has moved in direction 44, away from the end of slide member 22. However, locking members 54 are prevented from being inserted into recesses 54 because the portion of recess 54 located on frame 8 and the portion of recess 54 located on backrest 60 of the chair are not aligned such as to allow locking members 54 to be inserted therein. When locking members 52 are again able to move freely into recesses 54, both spring housing 26 and slide member 22 will move in direction 44 as the result of the decompression of spring 30.

As mentioned previously, in the event that locking members 52 are bound in recesses 54 by a weight placed on backrest 60 of the chair, or prevented from being inserted into recesses 54 because of a blockage thereof by backrest 60, motion 43 of cable 12, spring housing 26 and the actual movement of overload protection device 20 and the associated locking mechanism is accomplished when the binding is removed.

Through the use of the overload protection device 20, the user is able to feel the movement of cable 12 through the translation of the movement from the user lever to springs 24 and 30, however, the locking mechanism, while prevented from moving, is not overloaded to the point where it may break. In this way, the user is prevented from forcing the locking mechanism to move when it is unable to do so because of the presence of a binding condition.

It should be noted that actuators 14 and 16 can be of any shape to accommodate different designs for different purposes and that the invention is not meant to be limited by the exact shape of actuators 14 or 16, nor by the function of the mechanism as described, nor is its use to be limited to chairs or to the locking and unlocking of chair backrests. Likewise, connecting rods 50, locking members 52, recesses 54 and chair frame 8 may be of any configuration or shape. Overload protection device 20 is meant to be used with any configuration of chair members anytime binding is possible.

I claim:

1. A chair having a moveable backrest which may be locked against the movement thereof comprising:

a frame, said frame defining one or more recesses therein;

one or more locking members for insertion into said recesses, such that movement of said backrest with respect to said chair is locked when said one or more locking members are inserted into said one or more recesses;

an overload protection device, coupled to said one or more locking members; and a cable, attached to said overload protection device;

wherein said overload protection device translates a back and forth motion of said cable into a movement of said one or more locking members into and out of said recesses.

2. The chair of claim 1 wherein said overload protection device stores the back and forth motion of said cable when a binding condition exists which prevents movement of said one or more locking members into and out of said recesses until said binding condition is released.

3. A chair having a moveable backrest which may be locked against the movement thereof comprising:

a frame having one or more recesses defined therein;

one or more locking members for insertion into said recesses, such that movement of said backrest with respect to said chair is locked when said one or more locking members are inserted into said one or more recesses;

an overload protection device, coupled to said one or more locking members, said overload protection device comprising;

a housing coupled to said frame, said housing being able to move in a back and forth manner with respect to said frame;

a sliding member moveable within said housing such that movement of said sliding member in a first direction compresses a spring against said housing, causing said housing to be urged in said first direction; and a second spring, said second spring located outside said housing, such that movement of said housing in said first direction causes said second spring to become compressed;

a cable, attached to said overload protection device;

a cam, rotationally mounted on said frame; and a lever, for manually rotating said cam with respect to said frame, said rotation of said cam resulting in a linear motion of said cable.

4. The chair of claim 3 wherein said linear motion of said cable causes said sliding member to move in said first direction.

5. The chair of claim 4 wherein the decompression of said second spring causes said housing to move in a second direction opposite said first direction.

6. The chair of claim 5 further comprising one or more actuators coupled to said housing, such that the movement of said housing in either said first or said second directions causes the movement of said one or more actuators.

7. The chair of claim 6 wherein said one or more actuators are coupled to said housing via a rack and pinion gear assembly.

8. The chair of claim 7 wherein said one or more actuators may or may not move when said sliding member is moved in said first direction, thereby causing the compression of said first spring between said sliding member and said housing.

9. The chair of claim 6 wherein said one or more actuators are coupled to said one or more locking members to move said one or more locking members into and out of said one or more recesses.

10. The chair of claim 6 wherein said actuators are coupled to said locking members via connecting rods.

11. The chair of claim 10 wherein said connecting rods are connected to said actuators and said locking member via ball joints.

* * * * *